United States Patent [19]

Kawasaki et al.

[11] 3,938,227

[45] Feb. 17, 1976

[54] METHOD OF PRODUCING DEEPLY CREPED FABRIC WITH PARTIALLY BULKED YARN

[75] Inventors: Kentaro Kawasaki, Mino; Keizo Takizawa, Suita, both of Japan

[73] Assignee: Chori Company Limited, Osaka, Japan

[22] Filed: Dec. 26, 1973

[21] Appl. No.: 427,492

[30] Foreign Application Priority Data

Dec. 29, 1972 Japan ..... 47-1859

[52] U.S. Cl. ..... 28/72 FT; 57/157 R

[51] Int. Cl.[2] ..... D06C 23/04

[58] Field of Search .... 28/72 FT; 57/34 HS, 34 AF, 57/91, 144, 77.3, 77.37, 157 R, 157 TS, 156, 106

[56] References Cited

UNITED STATES PATENTS

| | | | |
|---|---|---|---|
| 2,245,641 | 6/1941 | Bell et al. | 28/72 FT |
| 2,948,133 | 8/1960 | Schwartz | 28/72 FT |
| 3,113,413 | 12/1963 | Jacobs et al. | 57/91 X |
| 3,116,588 | 1/1964 | Breen et al. | 57/34 AT |
| 3,412,543 | 11/1968 | Horvath | 57/34 HS |

*Primary Examiner*—Louis K. Rimrodt

*Attorney, Agent, or Firm*—Whittemore, Hulbert & Belknap

[57] ABSTRACT

A method of producing a novel deeply creped fabric by using partially bulked yarn. Gyratory (or torque-imparted) partially bulked yarn obtained from a known twisting - heat setting - untwisting process is additionally twisted, or said process is conducted on the pre-twisted yarn to give extra twists to the non-bulked portions, so as to make conspicuous the difference between the bulked and non-bulked portions, and a fabric is woven or knit by using such yarn and is subjected to a creping treatment.

6 Claims, 12 Drawing Figures

METHOD OF PRODUCING DEEPLY CREPED FABRIC WITH PARTIALLY BULKED YARN

BACKGROUND OF THE INVENTION

This invention relates to a method of producing a deeply creped woven or knitted fabric using partially bulked yarn.

Heretofore, for making a creped or crimped fabric with thermoplastic synthetic fibers, it has been the common practice to impart hard twist to the material yarn and make use of the resultantly produced torsional torque characteristic, or to use the already crimped yarn to utilize the stretchability and the torque that such yarn has. Crimped yarn is usually obtained from the steps of twisting, heat setting and untwisting by using, in most cases, a false twisting machine or an Italian type twisting frame, and such crimped yarn is used either in the form as is or by imparting extra twists to the yarn to utilize the torque that consequently develops.

The present invention features use of the yarn which is prepared by a novel method so as to obtain a novel fabric having an improved shape of the crimps. In the method of the present invention there is a novel partially bulked yarn obtained by imparting extra twist to the crimped yarn prepared from a common process of twisting, heat setting and untwisting, or by conducting said process on the pre-twisted material yarn.

BRIEF SUMMARY OF THE INVENTION

The present invention has for its object to obtain a woven or knit fabric having an excellent creping effect that could never be obtained with conventional methods. According to the present invention, the partially bulked yarn prepared from a twisting - heat setting - untwisting process is further worked so that the difference between the bulked and non-bulked portions become more conspicuous and so that greater retractability is provided in the yarn, and weaving or knitting is carried out using such yarn to obtain the improved fabric described.

In order to make the difference between the bulked and non-bulked portions conspicuous and to make the yarn retractable, a suitable number of twists is given to said bulked yarn. According to the method of the present invention, there are produced not only the fine crimps or crepes by crimping but also deep crimps due to the distortion that is produced in the texture, so that there is obtained a fabric having an intricate and large creping effect which is unobtainable with the prior art techniques.

DETAILED DESCRIPTION OF THE INVENTION

The partially bulked yarn of the present invention is manufactured in the following way.

Figure 2:
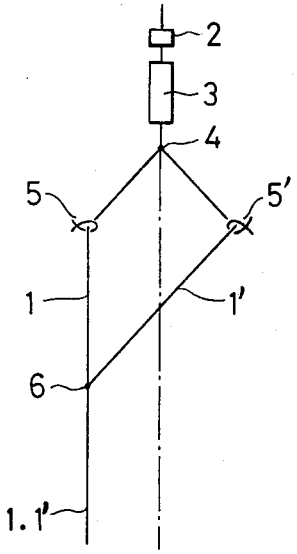
Fig. 2 PRIOR ART
FIGS. 1 to 3 are schematic drawings showing means for producing the change of tension between the grey yarns.
Figure 1:
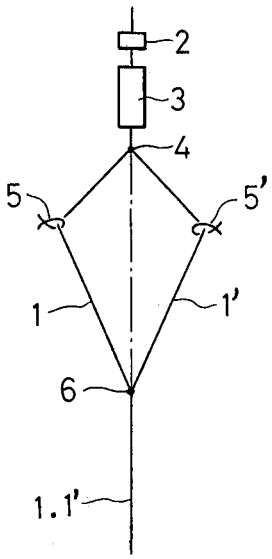
Fig. 1 PRIOR ART
Figure 3:
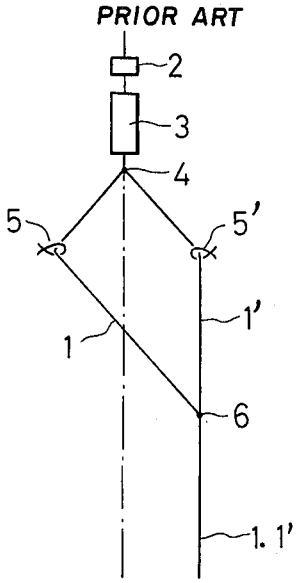
Fig. 3 PRIOR ART

Referring to FIG. 1, two pieces of grey yarn 1 and 1′ are supplied to the same twisting spindle 2 of a false twister and subjected to a series of processes where said two pieces of yarn in a doubled state are further twisted, heat set and untwisted. In the course of these processes, there is provided between the yarn feeding section and the twisting spindle a suitable means for intermittently producing a change in the tension between the two pieces of yarn. After passing the point 6, the respective yarns are given different feeding conditions. In FIGS. 1 to 3, reference numeral 3 denotes a heater, 4 the doubling point, and 5, 5′ the fixed guides.

In the process of FIG. 1, two grey yarns 1 and 1′ are under the same tension and undergo the usual false twisting in a paralleled state, but in the processes of FIGS. 2 and 3, the point 6 is moved to the left or to the right as shown, by means of a mechanism not shown, so that a difference in the tension is produced between the two yarns 1 and 1′. In the case of FIG. 2, the tension of the yarn 1 becomes smaller than that of the yarn 1′ and, under this condition, twisting is practiced by the false twisting spindle, so that sufficient twist is given to the yarn with the smaller tension while only insufficient twist is given to the yarn 1′ having greater tension. As a result, sufficient crimping is given to the yarn 1 while yarn 1′ is insufficiently crimped. In the case of FIG. 3, the situation is reversed. That is, the tension of yarn 1 becomes greater than that of yarn 1′, and therefore the performance is just the contrary to the case of FIG. 2. As the processes of FIGS. 1, 2 and 3 are practiced alternately with the advancement of the yarns and the movement of the point 6, there is obtained a partially bulked yarn.

Figure 4:
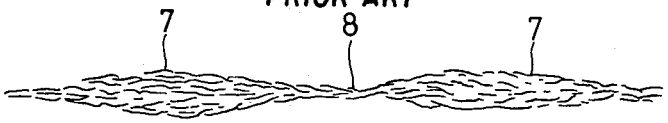
Fig. 4 PRIOR ART
FIG. 4 is a perspective view showing a part of a conventional partially bulked yarn.

When two pieces of grey yarns with different tensions are supplied to the twisting spindle, sufficient twisting is imparted to the yarn with the smaller tension but insufficient twist is given to the yarn with the greater tension, so that the former yarn undergoes sufficient crimping and is bulked as shown by 7 in FIG. 4, while the latter yarn receives little crimping work and remains substantially unbulked as shown by 8 in FIG. 4. As these operations are conducted intermittently, there is formed a partially bulked yarn with alternate bulked and non-bulked portions.

The partial bulked yarn having alternately arranged bulked and non-bulked portions is generally poorer in retractability and crimping torque than a usual crimped yarn prepared from a normal twisting - heat setting - untwisting process and crimped evenly throughout its length.

According to the method of the present invention, the partially bulked yarn obtained in the above-described way is further worked so as to further distinguish the bulked and non-bulked portions from each other and to provide greater retractability, and weaving or knitting is carried out using such yarn to produce a woven or knit fabric having a complicated and a large creping effect that can not be obtained with conventional methods. In order to make the bulked and non-bulked portions distinguish from each other and to give strong retractability to the yarns, a suitable number of twists are imparted to said partial bulked yarn. Such twisting may be made before practicing the partial bulking work (pre-twisting) and after completing such work (post-twisting), and the direction of twist may be either clockwise or counterclockwise.

Figure 5:
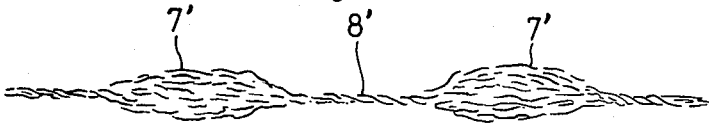
FIG. 5 is a perspective view showing a part of a partially bulked yarn of the present invention.

The term "partially bulked yarn" applies to a crimped yarn prepared from a common twisting - heat setting - untwisting process and having a gyratory characteristic (torque) along its full length. It is characterized by its specific structure where the bulked and non-bulked portions appear alternately, and each bulked portion is given sufficient crimping work so that each filament is thoroughly and finely crimped, while each non-bulked portion undergoes insufficient crimping work so that each filament therein is only roughly crimped and there is little difference between it and the non-worked filament. In this portion, therefore, there still exits the twist which has been given to the filaments prior to the partial bulking work, and hence if extra twisting is accomplished separately such extra twisting, even if slight in degree, will be concentrated in the non-bulked portion of the partially bulked yarn which is in an easily twistable state, while the bulked portion receives hardly any extra twist. As a consequence, the yarn assumes a general configuration such as that shown in FIG. 5, that is, the non-bulked portion 8 is further bundled owing to the concentration of the twist imparted and the difference of bulk height between the bulked portion 7' 7 and the non-bulked portion 8' becomes even more conspicuous.

Further, since the torsional torque derived from the concentrated twisting in the non-bulked portion is balanced, such torque works on the bulked portion and is added to the crimping torque which the bulked portion has inherently, so as to produce a synergistic effect. The resultant yarn has, therefore, a very high retractability. If a fabric is woven or knit using such yarn, the latter produces structural distorsion in the fabric so as to produce a prominent creping effect.

Figure 6:
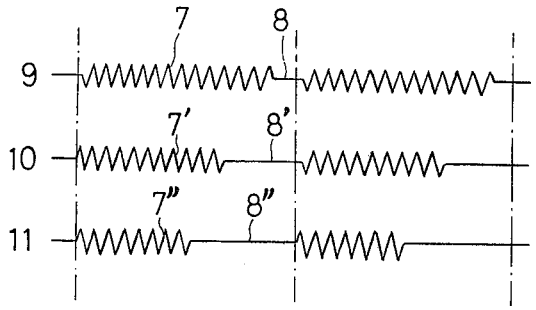
FIG. 6 is a diagram showing twisting of a partially bulked yarn and the change of condition of the bulked portion.

In the above-said twisting operation, the proportion of the bulked portions to the non-bulked portions in the partially bulked yarn can be varied by changing the degree of twisting. This is diagrammatically illustrated in FIG. 6, where numeral 9 indicates the proportion of the bulked portion 7 to the non-bulked portion 8 when the number of twists is zero, and numerals 10 and 11 represent such proportions as observed when the number of twists is gradually increased. It will be seen that the length of the non-bulked portion 8 is gradually elongated, as indicated by 8', and 8'' as the number of twists increases. The apparent twist number in the portion 8 is also increased. Also, the apparent diameter ratio signifying the difference of bulk height between the bulked portion 7 and the non-bulked portion 8 is naturally changed and enlarged proportionally to the number of twists.

Table 1 below shows the results of actual measurements conducted on said portions.

Table 1

| material | number of twists | length of bulked portion | : | length of non-bulked portion | apparent diameter ratio between bulked and non-bulked portion | apparent number of twist in non-bulked portion |
|---|---|---|---|---|---|---|
| polyester | t/m | | | | | t/m |
| 75d-36f | 70 | 88.9 | : | 11.1 | 1.7 | 630.6 |
| 75d-36f | 100 | 85.2 | : | 14.8 | 2.1 | 675.7 |
| 75d-36f | 160 | 81.3 | : | 18.7 | 2.2 | 855.6 |
| nylon | | | | | | |
| 40d-17f | 70 | 85.3 | : | 14.7 | 1.4 | 476.2 |
| 40d-17f | 100 | 82.7 | : | 17.3 | 1.6 | 578.0 |
| 40d-17f | 160 | 74.8 | : | 25.2 | 1.62 | 634.9 |
| 40d-17f | 300 | 85.1 | : | 34.9 | 1.5 | 859.6 |

The above results indicate that it is undesirable to excessively increase the number of twists. That is, if the number of twists is increased more than required the length of the bulked portion is shortened, allowing the twist to extend to the bulked portion to reduce its bulkiness, thereby resulting in a lessened partial bulking effect. Evaluation of the fabrics produced from the partially bulked yarn according to the present invention showed that the number of twists should be not more than 500 twist/meter (t/m). If twisting occurs at a greater frequency, the feeling of the texture is worsened, the creping effect is reduced and the texture surface is flattened. Therefore, the number of twist should usually be within the range of from 50 to 500 t/m, and for best results of feeling and creping effect, it should be around 150 t/m.

Thus, in the yarn of the present invention, since the twist is concentrated locally in the non-bulked portions of the yarn, even slight twisting produces extremely high creping effect which cannot be obtained with conventional methods unless hard twisting is carried out the rate of 2,000 to 3,000 t/m.

Figure 7:
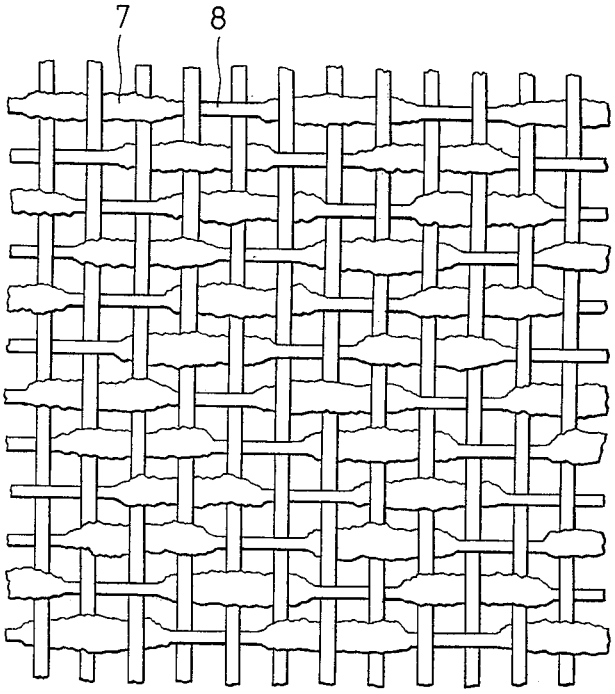
FIG. 7 is a diagrammatic view of a plain weave grey fabric obtained by using as weft the partially bulked yarn of the present invention.
Figure 8:
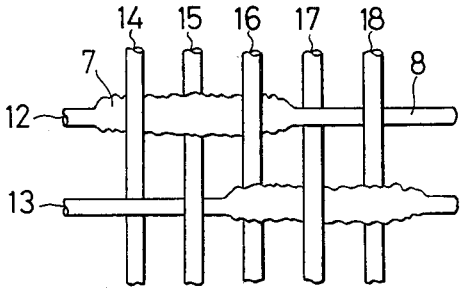
FIg. 8 is an enlarged view of a part of the grey fabric shown in FIG. 7.
Figure 9:
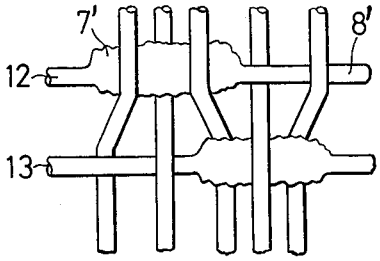
FIG. 9 is a fragmentary enlarged view of the fabric of FIG. 7, said fabric having been subjected to an after-treatment to shrink the bulky crimped portions of said partially bulked yarn.

Hereinafter is described the principle for producing crimps in the manufacture of a fabric by using the partially bulked yarn of the present invention. FIG. 7 shows a plain weave fabric woven by using as weft the novel yarn having the alternate bulked and non-bulked portions. In the grey fabric fragmentally shown in FIG. 8, if weaving is carried out so that each bulked portion 8 of the yarn intersects three pieces of warp and each non-bulked portion of the yarn intersects two pieces of warp, then the bulky crimped portion is shrunk by a suitable after-treatment, and the warp yarns 14, 15 and 16 are drawn up by the weft 12 while the warp yarns 16, 17 and 18 are drawn up by the weft 13 as shown in FIG. 9. As a result, distorsion occurs in the textural structure, producing a rugged surface and a creped texture. In the case when the woven texture is plain and the bulked yarn is used for weft, no effective creping occurs unless the length of one unit of the bulked and non-bulked portions spans at least more than two textures. Generally, too high a warp density produces diminished crimps and fine ruggedness, while too small a warp density develops large crimps and rough ruggedness. Also, the size of the crimps varies proportionally to the length of one unit of the bulked and non-bulked portions.

Figure 10:
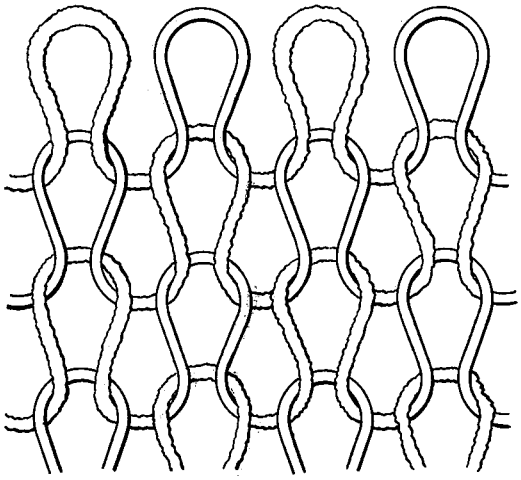
FIG. 10 shows a plain weave texture obtained by using the partially crimped yarn of the present invention.
Figure 11:
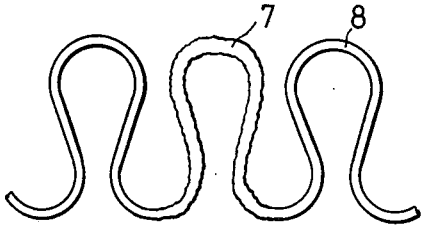
FIG. 11 is an enlarged view of one wale of the grey fabric shown in FIG. 7.
Figure 12:
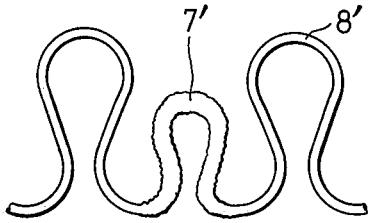
FIG. 12 is a view similar to FIG. 11, showing the condition of the wale which has undergone an after-treatment.

A practical application of the method of the present invention in a knitted fabric is shown in FIG. 10. Shown in the figure is a plain stitch fabric knitted by using the novel yarn having the alternate bulked and non-bulked portions. In the case where every bulked portion 7 form a loop, as shown in an enlarged view of FIG. 11, such bulked portion 7, upon undergoing an after-treatment, shrinks and its loop becomes smaller than that of the non-bulked portion, as indicated by 7' in FIG. 12. As a result, the loops in the texture become non-uniform, producing distortion in the textural structure and ruggedness on the surface. It is to be noted that an unsatisfactory creping performance is obtained unless the length of one unit of the bulked and non-bulked portions is long enough to allow formation of at least one loop of the wale. The size of the crimps formed can be optionally determined by suitably selecting the length of one unit of the bulked and non-bulked portions of the partially bulked yarn, textural density, and needle gauge. If the novel partially bulked yarn of the present invention is used in a fabric, even if it is of a most simple texture such as an interlock fabric or grey sheeting, there is obtained a rugged and complex surface which is just like a crepe fabric.

In order to obtain satisfactory results in application of the present invention to either knitted or woven fabrics, the length of one unit of the bulked and non-bulked portions of the yarn (in the case of FIg. 7, the length of bulked portion 7 + non-bulked portion 8) should be within the range of about 10 to 70 mm.

In actual fabrication of a woven or knitted fabric, it was found that if the length of one bulked portion 7 + adjoining non-bulked portion 8 is less than 10 mm, the formed crimps are too small and flat and the obtained product is commercially of substantially the same level as the conventional ones. On the other hand, if said length is greater than 70 mm, the resultant crimps are unduly enlarged and the texture surface is roughed, producing a commercially undesirable article.

EXAMPLE 1

A plain weave fabric was woven at grey fabric density of 188 pieces of warp per inch and 88 pieces of weft per inch, by using 50 denier-24 polyester filaments for warp and partially bulked yarn comprising 100 denier-48 polyester filaments for weft. The length of one unit of the bulked and non-bulked portions ( length of 7 + 8 in FIG. 7) of the partially bulked yarn was 25 mm, and the number of twist was 150 t/m. This fabric was creped in a relax work by treating said fabric in boiling water at a temperature of 90° to 95°C while giving impact, and the thus treated fabric was then refined, tentered and finished. There was consequently obtained a novel fabric texture having elegant and fine crimps with a crepe-de-Chine touch and deeper than those in the conventional products. The fabric density after the relax work was 220 pieces/inch for warp and 108 pieces/inch for weft, and the shrinking percentage was 19% for warp and 15% for weft.

EXAMPLE 2

A plain weave fabric was woven at the grey fabric density of 188 pieces of warp per inch and 80 pieces of weft per inch, by using the same yarn as in Example 1 for warp and the partially bulked yarn comprising 150 denier-48 polyester filaments for weft. The length of one unit of bulked and non-bulked portions of said partially bulked yarn was 35 mm, and the number of twists was 150 t/m. This fabric was finished by using the same after-treatment as in Example 1, obtaining a creped fabric having large and deep crimps with rough touch, that could never be obtained with the conventional thermoplastic synthetic fibers.

The density after the relax work was 226 pieces/inch of warp and 101 pieces/inch of weft, and the shrinkage percentage was 21% for warp and 17% for weft.

EXAMPLE 3

An interlock fabric was knit with a 30-inch bore and a 20-guage tubular knitting machine by using the partially bulked yarn comprising 150 denier-30 polyester filaments. The length of one unit of bulked and non-bulked portions of said yarn was 30 mm, and the number of twists was 100 t/m. This fabric was subjected to a relax work in a refining step, and then tentered, finished and set.

Grey fabric width: 141 cm
Relax width: 112.3 cm
Finish width: 130 cm
Shrinkage after the relax work: 20.5%

There was resultantly obtained a knit fabric having a simple interlock texture and an intricate rugged surface configuration with an aventurine-like touch.

What is claimed is:

1. A method of producing a deeply creped fabric comprising imparting an increased number of twists to a partly bulked yarn prepared from a twisting, heat-setting, untwisting process whereby the partly bulked yarn has bulked portions and non-bulked portions arranged alternately along the length of the yarn wherein the number of twists are increased mostly in the non-bulked portions of the yarn thereby making the difference between the bulked and non-bulked portions conspicuous and providing increased retractability for the yarn and manufacturing a fabric from the yarn with the additional twists and subjecting the fabric to a creping treatment.

2. The method as set forth in claim 1 whereby 50 to 500 additional twists per meter are applied to the partially bulked yarn.

3. The method as set forth in claim 1 wherein approximately 150 additional twists per meter are applied to the partly bulked yarn.

4. The method as set forth in claim 1 wherein the bulked yarn having the additional twists is used for both the warp and weft of the fabric and the fabric is woven.

5. The method as set forth in claim 1 wherein the bulked yarn having the additional twists is used for only the weft of the fabric.

6. The method as set forth in claim 1 wherein the length of one unit of the partially bulked yarn having the additional twists including one bulked and one unbulked portion is approximately 10 to 70 mm.

* * * * *